United States Patent [19]

Petrillo et al.

[11] 4,167,534

[45] Sep. 11, 1979

[54] PROCESS FOR THE PREPARATION OF SYNTHETIC LUBRICATING OILS

[75] Inventors: Vincenzo Petrillo; Andrea Peditto, both of Robassomero, Italy

[73] Assignee: Liquichimica Italiana S.p.A., Italy

[21] Appl. No.: 852,368

[22] Filed: Nov. 16, 1977

Related U.S. Application Data

[63] Continuation-in-part of Ser. No. 694,229, Jun. 9, 1976, abandoned.

[30] Foreign Application Priority Data

Jun. 11, 1975 [IT] Italy ..... 24263 A/75

[51] Int. Cl.[2] ..... C07C 5/04; C07C 3/18

[52] U.S. Cl. ..... 585/18; 585/255; 585/258; 585/259; 585/532

[58] Field of Search ..... 260/676 R, 683.9, 683.15 B; 252/59

[56] References Cited

U.S. PATENT DOCUMENTS

| | | | |
|---|---|---|---|
| 3,149,178 | 9/1964 | Hamilton et al. | 260/683.9 |
| 3,763,244 | 10/1973 | Shubkin | 260/676 R |
| 3,780,128 | 12/1973 | Shubkin | 260/683.9 |
| 3,907,924 | 9/1975 | Isa et al. | 260/683.9 |
| 3,947,507 | 3/1976 | Isa et al. | 260/683.15 B |
| 3,985,821 | 10/1976 | Girotti et al. | 260/676 R |
| 3,985,821 | 10/1976 | Girotti et al. | 260/676 R |
| 4,013,736 | 3/1977 | Woo | 260/676 R |
| 4,017,553 | 4/1977 | Cesca et al. | 260/676 R |
| 4,032,591 | 6/1977 | Cupples et al. | 260/683.9 |

*Primary Examiner*—C. Davis

*Attorney, Agent, or Firm*—Haseltine, Lake & Waters

[57] ABSTRACT

The invention relates to a synthesis process for preparing lubricating oils, according to which a n-olefin cut is subjected to catalytic autocondensation, under controlled conditions, and the reaction mixture is distilled, the bottom product, possibly stabilized to eliminate unsaturations, being the desired lubricating oil having outstanding properties of viscosity index and pour point.

3 Claims, No Drawings

PROCESS FOR THE PREPARATION OF SYNTHETIC LUBRICATING OILS

This is a continuation-in-part of our U.S. Patent Application Ser. No. 694,229 filed June 9, 1976, and now abandoned.

The present invention relates to the preparation of synthetic lubricating oils, of the hydrocarbon type, having special properties of viscosity, which render them adapted for use at low temperatures and, particularly, for use as lubricants for engines, as well as operating fluids for braking circuits and servo-assisted systems, aeronautical engines and constructions, oil for refrigerating circuits, etc.

In the following disclosure, by properties of viscosity there are intended both the variability of the viscosity upon varying the temperature, and the pour point, i.e. the lowest temperature at which an oil can still be considered liquid and thus circulate in a lubricating circuit.

The possibility is known, since some time, of condensing compounds containing double or triple bonds, both thermally and catalytically, with other substances containing, if any, double or triple bonds, as well as the fact that the compounds containing double or triple bonds are capable of auto-condensing, either thermally or catalytically, to form compounds having higher molecular weight.

The isomerizing or cyclizing action of some compounds, such as for instance the Lewis acids, is also known, this action taking place with respect to substances containing, if any, double and triple bonds, the same compounds being also capable of acting as a condensation catalyst in the above stated manner.

It is also known in the related field the possibility of obtaining hydrocarbons having a molecular weight enough high to permit their use as lubricating oils, starting from low molecular weight alpha-olefins, by effecting a condensation and an isomerization, preferably simultaneously, by using catalysts of the Friedel-Crafts type, particularly aluminium halides, simple or mixed, or by operating in the absence of catalysts under the action of heat alone; in both cases the resulting products can be purified from the light fractions and can be, if desired, hydrogenated in order to increase their stability. These hydrocarbons, owing to the fact that their structure is essentially devoid of long linear chains (the so-called paraffin waxes), have highly favorable pour points, the viscosity indexes being generally of the same level or better than the lubricating paraffinic oils deriving from crude oil.

It has now been found that the above mentioned process can be essentially modified and improved, both as regards the starting raw material, and as regards the carrying out of the process, and lastly with respect to the properties and yields of the resulting synthesis product.

To this end, the process according to the present invention for the synthesis of lubricating oils starting from olefin hydrocarbons is characterized by the operations of catalyzed auto-condensation of n-olefins and distillation of the reaction product for the separation of the unreacted olefin fraction and of a bottom fraction forming the desired lubricating oil, a stabilization step, consisting in the saturation of the double and triple bonds still present in the product of the auto-condensation, being possibly carried out either before or after the said distillation.

As it is well known, by n-olefins the olefins are meant in which the double bond is present not only in the 1–2 position (alpha-olefins), but is statistically distributed along the entire chain.

These n-olefins are preferably obtained according to the process called PACOL-OLEX by dehydrogenation of n-paraffins.

More particularly, it has been found that the raw material suitable for the present process can consist of n-olefins having a number of carbon atoms of between 9 and 18, or of mixtures of n-olefins, still having a number of carbon atoms of between 9 and 18, the cuts having a number of carbon atoms of between 10 and 15 being preferred; no essential differences were found in the final product as a function of the relative ratios of the components in the above mentioned cut, since the characteristic properties, namely high viscosity index and low pour point, were anyhow maintained.

The condensation can be carried out in a number of ways differing either as the times, or as the temperatures or as the conditions in which the reactants are contacted.

More particularly it can be carried out by either adding, gradually or instantaneously, the catalyst to the n-olefin, or by adding the olefin to a concentrated solution of the catalyst, the reaction being carried out under isothermal or adiabatic conditions, the temperatures being comprised between 20° and 200° C.

The viscosity properties of the final product as well as the conversion yields can be varied as a function of the above mentioned operating variables; the essential properties of viscosity index and pour point are, however, always maintained, the viscosity index being generally higher than 100 and the pour point being lower than −40° C., respectively. On the contrary, the unsaturation degree of the final product is variable as a function especially of the temperature and, in some cases, particularly when operating at high temperatures, it is already possible to obtain from the condensation step essentially saturated oils, whereby the subsequent hydrogenation step becomes not strictly necessary. The catalysts which are preferred for the condensation step are those of the Friedel-Crafts type, particularly the aluminium halides or the mixed halides of aluminium and of an alkali metal. More particularly the following compounds are useful: $AlCl_3$, $AlBr_3$, $LiAlCl_4$, $LiAlBr_4$, $NaAlCl_4$, $NaAlBe_4$, $KAlCl_4$ and $KAlBr_4$, the very preferred compound being $AlCl_3$. The catalyst amount which is used with respect to the olefin is variable between 0.1% and 10% by weight, preferably between 0.5% and 2% by weight.

As already mentioned, according to the process, a possible stabilization step is foreseen, aiming to improve the stability to the heat and to the oxidation, the treatment being carried out on the bottom product of the distillation, which constitutes the desired lubricating oil. Such a stabilization preferably comprises a catalytic hydrogenation, of a per se known type. Such an operation can be carried out either before or after the separation by distillation of the unreacted fraction of the reaction mixture: it is, however, preferable to effect the hydrogenation only on the bottom product of the distillation, whereby the unreacted olefinic fraction, obtained as the head product of the distillation column, can be recycled to the condensation.

The following Examples, even if they should not be construed in a limiting sense, illustrate the invention with respect to a batch process, it being understood that the same process can be practiced without difficulties in a continuous manner.

EXAMPLE 1

A $C_{11}$-$C_{14}$ n-olefin cut, obtained by dehydrogenation of the corresponding n-paraffins as prepared by the ISOSIV process, and containing:

n-undecene: 19.6%
n-dodecene: 30.2%
n-tridecene: 25.3%
n-tetradecene: 18%
isomers: 3.7%
light compounds: 0.2%
heavy compounds: 1%
paraffins: 0.5%
aromatics: 1.4% was heated to 80° C., and then added over 15 minutes with 1% $AlCl_3$. The temperature was raised to 100° C. and maintained thereto for 100 minutes. The product was then discharged, separated from the heavy catalytic layer, washed with caustic solution and distilled. The heavy fraction, corresponding to the 45% of the charge, had the following properties:

Bromine number: 7.5
pour point: −60° C.
viscosity at 100° F.: 31.4 cst
V.I.: 110

EXAMPLE 2

The oil of the Example 1 was hydrogenated in the presence of 10% Ni Raney at a temperature of 200° C. for 4 hours under a pressure of 50 atmospheres. The thus obtained product showed the following properties:

Bromine number: 2
pour point: −60° C.
viscosity at 100° F.: 32.7 cst
V.I.: 115

EXAMPLE 3

An olefin cut, like that used in the Example 1, was heated to 40° C. and then added over 15 minutes with 3% $AlCl_3$. The temperature was raised to 150° C. and maintained thereto for 120 minutes. The product was then discharged, separated from the heavy catalytic layer, washed with caustic solution and distilled. The heavy fraction, corresponding to 88% of the charge, showed the following properties:

Bromine number: 2.3
pour point: −50° C.
viscosity at 100° F.: 41 cst
V.I.: 90

EXAMPLE 4

The oil of the Example 3 was hydrogenated under the conditions of the Example 2. The resulting product had the following properties:

Bromine number: 0.6
pour point: −50° C.
viscosity at 100° F.: 38.4 cst
V.I.: 110

EXAMPLE 5

A n-olefin cut, like that used in the Example 1, was added at room temperature with 1% $AlCl_3$, in only one portion. The temperature raised by itself to 80° C. and was maintained to this value for 120 minutes. The product was then discharged, separated from the heavy catalytic layer, washed with caustic solution and distilled. The heavy fraction, about 25%, had the following properties:

Bromine number: 8.6
pour point: −60° C.
viscosity at 100° F.: 38.4 cst
V.I.: 131

EXAMPLE 6

The oil of the Example 5 was hydrogenated under the conditions of the Example 2. The thus obtained product had the following properties:

Bromine number: 0.2
pour point: −60° C.
viscosity at 100° F.: 41.5 cst
V.I.: 115

EXAMPLE 7

A n-olefin cut, like that used in the Example 1, was added at 130° C. with 5% $NaAlCl_4$ over 90 minutes. The reaction mass was then maintained at 130° C. for further 60 minutes. The product was then discharged, separated from the heavy catalytic layer, washed with caustic solution and distilled. The heavy portion showed the following properties:

Bromine number: 9.7
pour point: −60° C.
viscosity at 100° F.: 30.5 cst
V.I.: 140

EXAMPLE 8

The oil of the Example 7 was hydrogenated under the conditions of the Example 2. The resulting product had the following properties:

Bromine number: 0.4
pour point: −58° C.
viscosity at 100° F.: 30 cst
V.I.: 140

EXAMPLE 9

A $C_{10}$-$C_{13}$ n-olefin cut, having the following distillation curve:

IBP: 189° C.; (372.2° F.)
5%: 193° C.; (379.4° F.)
10%: 194° C.; (381.2° F.)
20%: 196° C.; (384.8° F.)
30%: 198° C.; (388.3° F.)
40%: 200° C.; (392.0° F.)
50%: 202° C.; (395.6° F.)
60%: 204° C.; (399.2° F.)
70%: 207° C.; (404.6° F.)
80%: 211° C.; (411.8° F.)
90%: 216° C.; (420.8° F.)
95%: 221° C.; (429.8° F.)
E.P.: 230° C.; (446.0° F.)

was treated according to Example 1, apart that the reaction temperature was 105° C. and the reaction time was 90 minutes.

A product was obtained having the following distillation curve:

IBP: 189° C.; (372.2° F.)
5%: 195° C.; (383.0° F.)
10%: 199° C.; (390.2° F.)
20%: 206° C.; (402.8° F.)
30%: 214° C.; (417.2° F.)
40%: 233° C.; (451.4° F.)
50%: 319° C.; (606.2° F.)
60%: 339° C.; (642.2° F.)
70%: 349° C.; (660.2° F.)

80%: 356° C.; (672.8° F.)

90%: 361° C.; (681.8° F.)

No data were obtainable above 90% due to decomposition.

From the preceding data it is readily appreciated that in the precondensate according to the present invention a boiling point higher than the end point (E.P.) of the starting cut is obtained only at the 40% level, which means that the fraction from 40 to 90% gives place to the desired lubricating oil, whereas the unreacted olefin fraction resulting as the head product in the distillation step is recycled to the condensation reaction, thus affording a further advantage, namely the essential absence of waste products and the almost complete utilization of the starting raw material.

What we claim is:

1. A process for preparing synthetic lubricating oils from n-olefins, which comprises catalytically autocondensing n-olefins having from 10 to 15 carbon atoms wherein the double bond of said olefin is statistically distributed throughout the carbon chain at a temperature of from 20° to 200° C., utilizing 0.1–10% of a Friedel Crafts catalyst by weight of n-olefin, separating a light fraction and a bottom fraction by distillation and stabilizing said bottom fraction by catalytically hydrogenating any residual double- or triple-bonded hydrocarbons in said bottom fraction, said bottom fraction comprising the desired lubricating oil.

2. A process according to claim 1 wherein the catalyst is $AlCl_3$.

3. Synthetic lubricating oil, when prepared by the process according to claim 1.

* * * * *